United States Patent [19]

Homar

[11] Patent Number: 4,756,171

[45] Date of Patent: Jul. 12, 1988

[54] LUGGAGE LOCK SYSTEM

[76] Inventor: Paul F. Homar, 1824 Wilshire Ct., Casper, Wyo. 82604

[21] Appl. No.: 20,608

[22] Filed: Mar. 2, 1987

[51] Int. Cl.[4] ..... E05B 73/00

[52] U.S. Cl. ..... 70/18; 70/30; 70/69

[58] Field of Search ..... 70/18, 63, 67, 69, 30, 70/49; 242/71.3, 71.6, 84.8

[56] References Cited

U.S. PATENT DOCUMENTS

| | | | |
|---|---|---|---|
| 1,469,830 | 10/1923 | Tessier | 242/71.3 |
| 3,611,760 | 10/1971 | Mother | 70/18 |
| 3,906,758 | 9/1975 | Hurwitt | 70/30 |
| 4,325,238 | 4/1982 | Scherbing | 70/18 |

FOREIGN PATENT DOCUMENTS

| | | | |
|---|---|---|---|
| 1032266 | 3/1953 | France | 70/69 |
| 482574 | 7/1953 | Italy | 70/69 |
| 123470 | 11/1948 | Sweden | 70/18 |

*Primary Examiner*—Robert L. Wolfe

*Attorney, Agent, or Firm*—Dean P. Edmundson

[57] ABSTRACT

A locking system is described for securing luggage to a fixed object to prevent the theft or unauthorized removal of such luggage. The unique system comprises a compact durable housing having an opening therein, a rotatable spool contained within the housing, a length of flexible cable carried on the spool, the cable having first and second ends. The second end of the cable is secured to the spool; and the first end includes a first component of a separable lock device. A second component of the lock device is secured to the housing in a manner such that when the first end of the cable is withdrawn from the housing, passed through a handle or loop of the luggage, and then around the fixed object, the first component of the lock device can be coupled to the second component to thereby secure the luggage to the fixed object. The locking system is especially suited for use by travelers to secure their luggage in terminals (e.g., airports, depots, etc.) so that it is protected from theft or unauthorized removal. The locking system is small and light-weight so that it is easily carried and stored. In an alternative embodiment the locking system may be secured to an interior wall of an item of luggage having two openings therein. The first end of the cable can be pulled through one of the openings, passed around a fixed object, and then through the other opening where it is coupled to the second lock component.

18 Claims, 3 Drawing Sheets

LUGGAGE LOCK SYSTEM

FIELD OF THE INVENTION

This invention relates to security systems. More particularly, this invention relates to security systems for protection of personal items such as luggage, attache cases, etc. from theft or unauthorized removal from public areas.

BACKGROUND OF THE INVENTION

Travel by individuals appears to be increasing all over the world. Much of such travel is by means of common carriers such as airplanes, buses and trains.

A common problem facing almost all of such travelers concerns the safekeeping of luggage which they carry into the terminals and onto the carrier (e.g., airplane, bus, train, etc.). Such items include suitcases, attache cases, handbags, cosmetic cases, and a wide variety of carrying cases of all types and descriptions. Generically all of these items are referred to herein as luggage.

If the individual does not check the luggage with common carrier for handling during the trip, then the individual is responsible for carrying the luggage and for its safekeeping in the terminal. Typically this means that the individual must keep the luggage with himself or herself at all times to prevent theft or unauthorized removal. This can be extremely inconvenient when the individual must go to the restroom, or to the restaurant, or to locate and use a telephone, particularly when the individual is carrying more than one item of luggage (e.g., a suitcase and an attache case, or two suitcases, or multiple carrying cases).

Although most terminals include a limited number of lockers which may be rented for the purpose of storing items, the lockers are not always easy to locate nor are they conveniently located for every traveler. Furthermore, the lockers are not always large enough to accommodate all the items which the individual has to store. Moreover, there is a charge for each use of the locker and that could amount to a considerable sum of money for even the occasional traveler.

Various types of locking devices have been previously proposed for securing bicycles or the like. See, for example, U.S. Pat. Nos. 3,906,758; 3,910,081; 4,028,916; 4,033,160; 4,064,715; 4,068,504; 4,099,394; 4,112,720; 4,126,024; 4,188,808; and 4,404,822.

However, there has not heretofore been provided any means or suggestion for a convenient locking system to prevent theft or luggage in terminals, etc. Typically bicycle locking systems are not convenient or suitable for use by persons travelling on common carriers.

SUMMARY OF THE PRESENT INVENTION

In accordance with the present invention there is provided a unique locking system and method for securing luggage to a fixed object to prevent the theft or unauthorized removal of the luggage from public places such as airports, terminals, bus depots, train depots, restaurants, public office buildings, libraries, etc. The locking system comprises a compact durable housing having an opening therein, a rotatable spool contained within the housing, and a length of flexible cable carried on the spool.

The cable has first and second ends, wherein the second end is secured to the spool. The first end of the cable includes a first component of a separable lock device. A second component of the lock device is secured to the housing. Thus, the first end of the cable can be withdrawn from the housing, passed through a handle or loop of the luggage and then around a fixed object. The first component of the lock device can then be coupled to the second component of the lock to thereby secure the luggage to the fixed object.

Alternatively, the locking system may be incorporated into the luggage item itself. For example, the locking system may be secured within a suitcase, brief case, etc. with appropriate openings in the wall of the luggage to enable one end of the cable to be pulled out, passed around a fixed object, and then inserted into the second lock component.

The locking system of this invention enables a person to secure his or her luggage items to any convenient fixed object and then have the freedom to walk around the terminal or depot, go to the restroom, or a restaurant, or to use the telephone, etc. without danger of having the luggage stolen or moved or lost. This is especially useful for parents traveling with small children because its use enables the parents to walk about the terminal with the children without having to worry about the safety of their luggage. The locking system is compact and light-weight so that it can easily be carried in a travel bag, pocket, purse, attache case, etc. when not being used.

Other advantages of the locking system and method of this invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
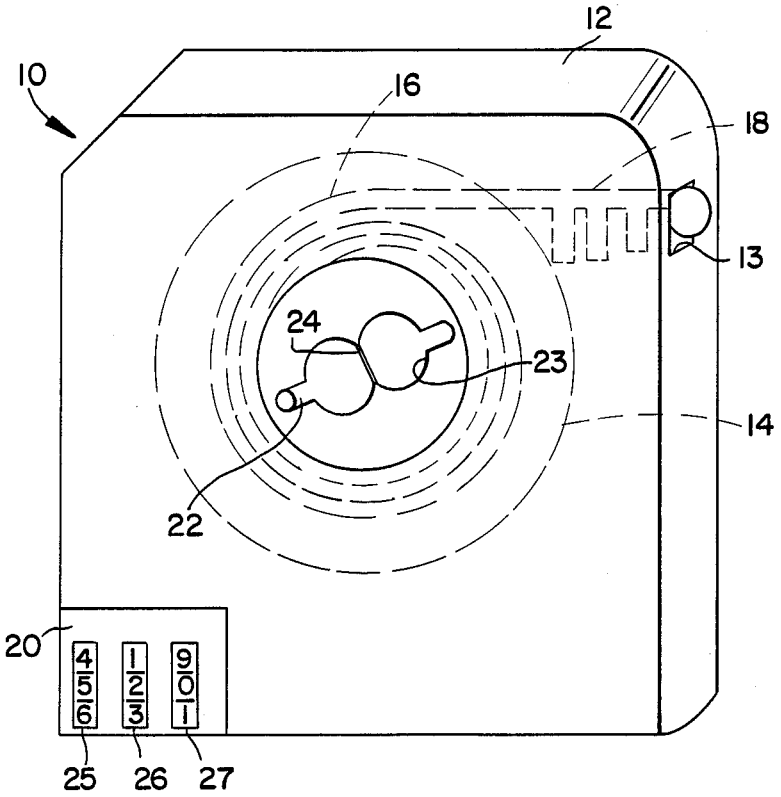
FIG. 1 is a perspective view of a preferred embodiment of luggage locking system of this invention.

In FIG. 1 there is shown a perspective view of a preferred locking system 10 of the invention. The locking system includes a compact, durable, impact-resistant case or housing 12 having an opening 13 on one side thereof.

Figure 2:
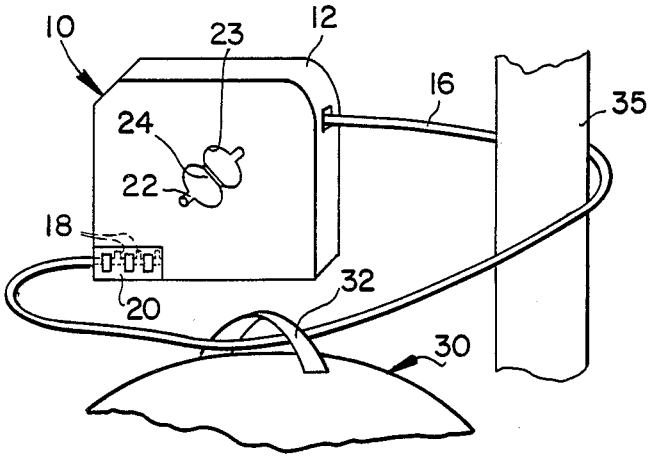
FIG. 2 illustrates one manner in which the luggage locking system is used.
Figure 3:
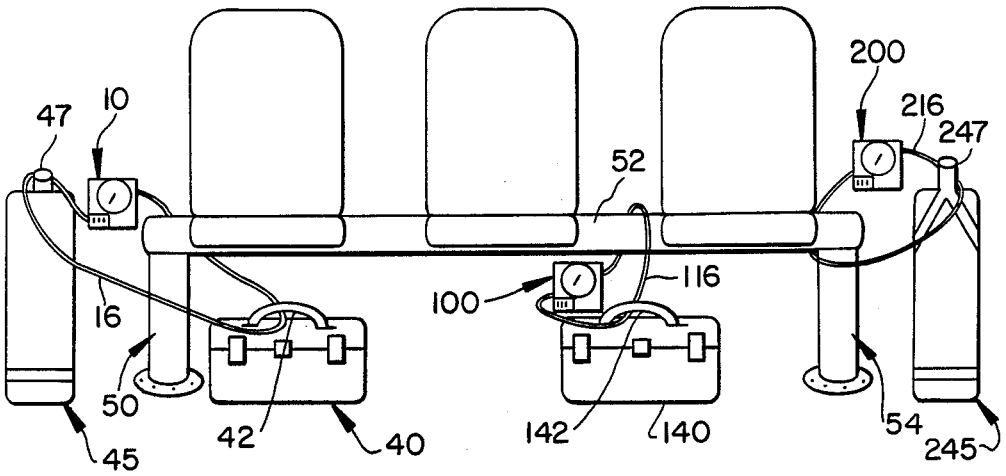
FIG. 3 illustrates another manner in which the luggage locking system may be used to secure luggage in a terminal.

A rotatable spool 14 is contained within the housing. A length of flexible cable 16 is carried on the spool. One end of the cable is secured to the spool and the opposite end includes as an attachment thereto a first component 18 of a separable lock device. A second component 20 of the lock device is secured to the housing. Preferably the second component 20 is contained within the housing, as illustrated, so that a secure closed loop is formed when the first lock component 18 is inserted into and coupled with the second lock component 20 (as illustrated in FIGS. 2 and 3).

In the embodiment of locking system shown in the drawings, there is further included a crank handle 22 on the exterior of the housing which is operably connected to the spool. Thus, the crank may be used to rotate the spool 14 within the housing so as to wind the cable onto the spool. In other words, the crank is used to retract the cable into the housing or casing when the locking system is not being used.

If desired, a latch mechanism may be included to retain the cable within the casing or housing when the locking system is not being used. For example, a clip member may be positioned adjacent the opening 13 in the housing or casing for the purpose of latching or retaining the first lock component 18 to the housing at opening 13. Other types of retention members may be used to prevent the first lock component from exiting the housing when the locking system is not being used.

Preferably the side of the casing or housing 12 includes a recess 23 into which the crank handle 22 may be received when it is not used. In other words, the crank handle is pivotable (by means of hinge 24) between an outward position (shown in FIGS. 1 and 2) and an inward or closed position in which it rests within recess 23.

The second lock component 20 is illustrated in the drawings as including a combination lock. That is, the lock can only be opened by first dialing the proper predetermined numerical combination on dials 25, 26 and 27. Thus, with this type of lock it is not necessary to have or to use a key to open it. It is only necessary to rotate each dial until the proper digits are aligned in the center of the dials. Then the first lock component 18 may be withdrawn or freed from the second lock component 20. Alternatively, the second lock component could comprise a conventional key lock, if desired.

FIG. 2 illustrates one typical manner in which the locking system 10 is used to secure an item of luggage 30 to a fixed object 35 (such as a pole, railing, chair mounting post, etc.) The first end of the cable is withdrawn from the casing 12 and then passed around the fixed object 35, then through handle or loop 32 on the luggage item, and finally the first lock component 18 on the end of the cable is inserted into the second lock component 20 in the casing 12. Of course, the cable could instead be first passed through the handle or loop on the luggage and then around the fixed object before being inserted into and secured by the second lock component.

FIG. 3 illustrates other typical uses of the locking system of this invention. Thus, carrying case 40 and suitcase 45 are shown being secured to a chair support mounting 50 using a single locking system 10 of the invention. Cable 16 extends from the casing or housing around the chair support mounting, through the handle 42 on carrying case 40, then through handle 47 on suitcase 45 and finally into the second lock component within the casing or housing.

Also shown in FIG. 3 is a locking system 100 being used to secure a carrying case 140 to chair frame 52. The cable 116 is looped around the chair frame 52, then through handle 142 on case 140, and finally the first lock component is coupled with the second lock component in the lock system 100.

Another typical use of the locking system is also illustrated in FIG. 3 where locking system 200 is used to secure suitcase 245 to chair frame section 54. The cable 216 is passed through handle 247 of suitcase 245, then it passes around chair frame 54, and finally the first lock component is coupled with the second lock component in the locking system 200.

The locking system can be used in a similar manner to secure various other items in public places. For example, the locking system of the invention can be used to secure attache cases, bags of various types, etc. in terminals, depots, libraries, public restrooms, and various other public places.

The case or housing of the locking system is made of a hard, durable, and impact-resistant material such as metal or tough plastic. The cable preferably comprises metal (e.g., twisted or braided wire) and is preferably coated with plastic to prevent corrosion and wear.

The length of the cable may vary, for example, from about 36 inches to 72 inches. A preferred length is in the range of about 48 inches to 66 inches. The diameter of the cable may also vary, for example from about 3/32 to 5/16 inch. A preferred diameter is in the range of about $\frac{1}{8}$ to $\frac{1}{4}$ inch.

The size of the case may also vary. Preferably it is no larger than about 4 to 5 inches square, with a thickness no greater than about 1.5 inches. A very convenient size is about 4 inches square by about one inch thick. This enables the locking system to be easily carried in a purse, attache case, travel bag, or even in a coat pocket. The case may also be provided in any of a variety of colors, if desired.

Figure 4:
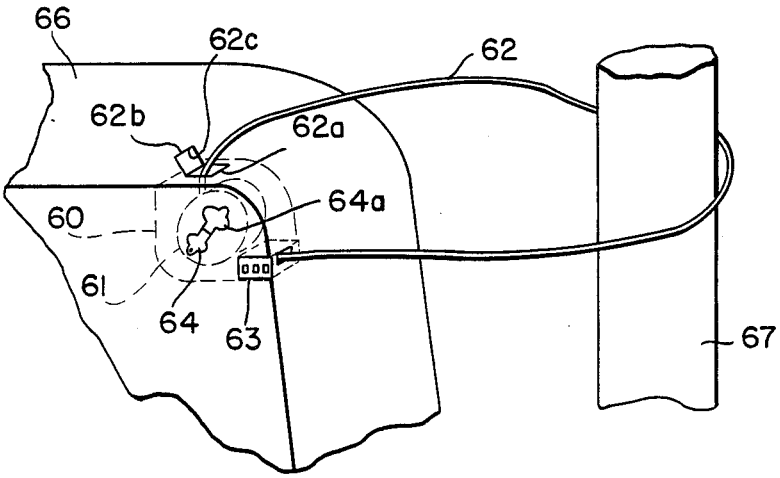
FIG. 4 illustrates yet another embodiment of locking system of the invention.

Another embodiment of locking system 60 is illustrated in FIG. 4. In this embodiment the locking system housing 60 is secured to the interior wall of an item of luggage 66 (e.g., a suitcase, brief case, travel bag, carrying case, etc.). A length of flexible cable 62 is attached at one end to spool or reel 61 within the locking system case. One end of the cable which includes a first lock component may be pulled through opening **62*a*, looped around a fixed object 67, and then inserted into an opening in the second lock component 63**, as illustrated, where it is releasably secured. The second lock component may be a combination lock component, as illustrated, or it may be a key-operated lock component.

If desired, a hinged cover **62*b* may be provided to cover the opening 62*a* when the locking system is not being used. A clip member 62*c* on cover 62*b*** may be included to hold the cover in the closed position.

The cable 62 is wound onto rotatable spool or reel 61. Crank handle 64 is adapted to wind the cable onto the spool. Preferably the crank handle is pivotable so that it may be pivoted into recess **64*a*** when the handle is not being used.

Figure 5:
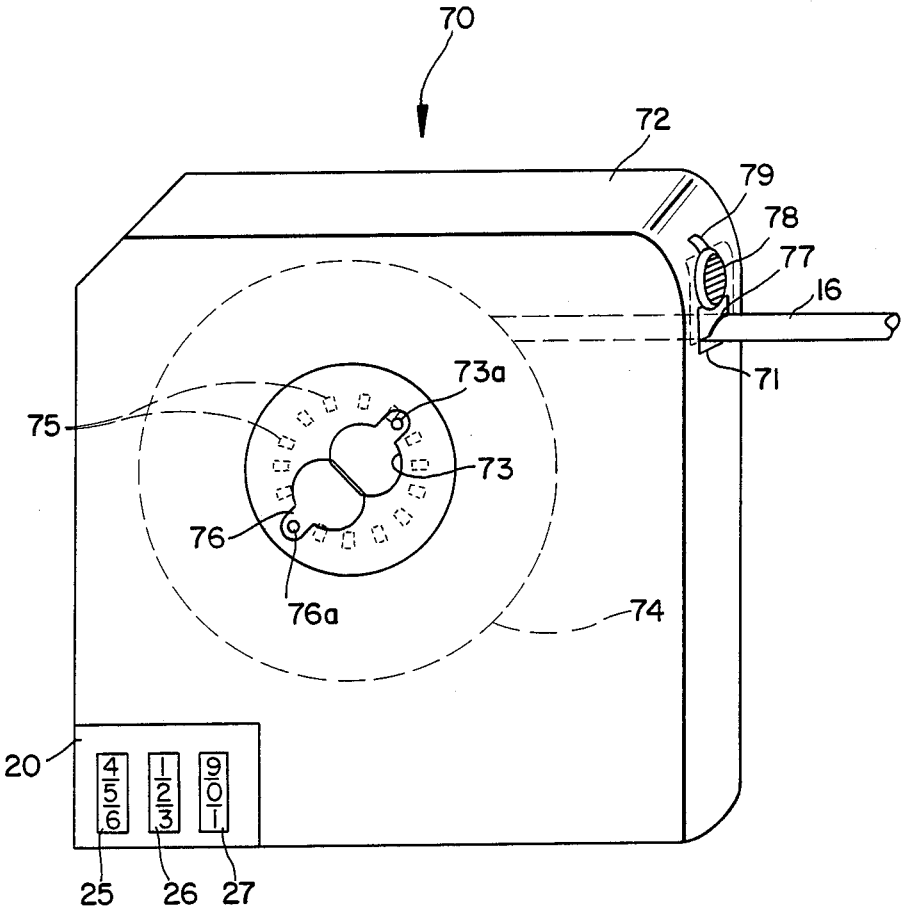
FIG. 5 illustrates another embodiment of locking system of the invention.

Yet another embodiment of locking system 70 is illustrated in FIG. 5. In this embodiment the cable 16 is wound on spool or reel 74 in case or housing 72. One end of the cable may be withdrawn through opening 71. In order to prevent additional amounts of cable 16 from being withdrawn from case 72, button 78 may be moved downwardly (as illustrated) in order to move retention member 77 against cable 16 to hold it in place. Button 78 includes a shank (not shown) which extends through vertical slot 79 and is connected directly to retention member 77. When it is desired to release cable 16, button 78 is pushed upwardly so as to move retention member 77 out of contact with cable 16.

Also illustrated in FIG. 5 is crank member 76 which includes handle **76*a*. The crank member is pivotable into recess 73** in the manner described above in connection with the other embodiments.

Recess 73 includes opening **73*a* which can be registered with an aperture in the side wall of case 72. One edge or face of spool 74 includes spaced-apart teeth or protrusions 75**, as illustrated.

When the crank 76 is pivoted into the recess 73, the tip of the handle 76a protrudes through opening 73a and the registering aperture in case 72. In this manner the tip of handle 76a can rest between two adjacent teeth 75 and thereby prevent accidental or unintended rotation of spool 74. This also prevents additional amounts of cable 16 from being pulled out of casing 72.

In the embodiment shown in FIG. 5, the second lock component 20 is of the same type as is illustrated in FIGS. 1 and 2.

Other variants are possible without departing from the scope of the present invention.

What is claimed is:

1. A portable locking system for securing luggage to a fixed object to prevent the theft or unauthorized removal of said luggage, said system comprising a compact durable housing having an opening therein, a rotatable spool contained within said housing, a length of flexible cable carried on said spool, said cable having first and second ends; wherein said second end of said cable is secured to said spool; wherein said first end includes a first component of a separable lock device; wherein a second component of said lock device is secured to said housing in a manner such that when said first end of said cable is withdrawn from said housing, passed through a handle or loop of said luggage, and then around said fixed object, said first component of said lock device can be coupled to said second component to thereby secure said luggage to said fixed object; and further comprising a crank handle accessible on one side of said housing, said crank handle being operably connected to said spool in a manner such that said cable can be wound onto said spool by rotation of said crank handle.

2. A locking system in accordance with claim 1, wherein said second lock component comprises a combination lock.

3. A locking system in accordance with claim 1, wherein said second lock component comprises a key-operated lock.

4. A locking system in accordance with claim 1, wherein said cable has a length in the range of about 36 to 72 inches.

5. A locking system in accordance with claim 1, wherein said cable comprises twisted wire within a plastic covering.

6. A locking system in accordance with claim 1, wherein said side of said housing includes a recess; wherein said crank handle is pivotable between open and closed positions; and wherein said crank handle is adapted to reside in said recess when said crank handle is in said closed position.

7. A locking system in accordance with claim 1, wherein said cable has a diameter in the range of about 3/32 to 5/16 inch.

8. A locking system in accordance with claim 1, wherein said housing comprises metal.

9. A locking system in accordance with claim 1, wherein said housing comprises impact-resistant plastic.

10. A method for securing luggage to a fixed object to prevent the theft or unauthorized removal of said luggage comprising the steps of:

(a) providing a portable locking device comprising a compact durable case having an opening therein; a rotatable spool contained within said case, a length of flexible cable carried on said spool; said cable having first and second ends; wherein said second end of said cable is secured to said spool; wherein said first end includes a first component of a separable lock device; wherein a second component of said lock device is secured to said case; and further comprising a crank handle accessible on one side of said housing, said crank handle being operably connected to said spool in a manner such that said cable can be wound onto said spool by rotation of said crank handle;

(b) withdrawing said first end of said cable from said case through said opening;

(c) passing said first end of said cable through a handle or loop on said luggage and around said fixed object; and (d) coupling said first component of said lock device to said second component to thereby secure said luggage to said fixed object.

11. A method in accordance with claim 10, wherein said second lock component comprises a combination lock.

12. A method in accordance with claim 10, wherein said second lock component comprises a key-operated lock.

13. A method in accordance with claim 10, wherein said cable has a length in the range of about 36 to 72 inches and a diameter in the range of about 3/32 to 5/16 inch.

14. A method in accordance with claim 10, wherein said cable comprises twisted wire within a plastic covering.

15. A method in accordance with claim 11, wherein said side of said housing includes a recess; wherein said crank handle is pivotable between open and closed positions; and wherein said crank handle is adapted to reside in said recess when said crank handle is in said closed position.

16. A method in accordance with claim 10, wherein said housing comprises metal.

17. A method in accordance with claim 10, wherein said housing comprises impact-resistant plastic.

18. A portable locking system for securing luggage to a fixed object to prevent the theft or unauthorized removal of said luggage, said system comprising a compact, durable impact-resistant housing having an opening therein, a rotatable spool contained within said housing, a length of flexible cable carried on said spool, said cable having first and second ends; wherein said second end of said cable is secured within said spool; wherein said first end includes a first component of a separable lock device; wherein a second component of said lock device is secured to said housing in a manner such that when said first end of said cable is withdrawn from said housing, passed through a handle or loop of said luggage, and then around said fixed object; wherein said lock device comprises a combination lock; and further comprising a crank handle accessible on one side of said housing, said crank handle being operably connected to said spool in a manner such that said cable can be wound onto said spool by rotation of said crank handle; and wherein said cable has a length in the range of about 36 to 72 inches and a diameter in the range of about 3/32 to 5/16 inch.

* * * * *